United States Patent [19]

Comstock

[11] 4,014,026

[45] Mar. 22, 1977

[54] POWER OPERATED ANTENNA ASSEMBLY

[75] Inventor: Douglas K. Comstock, Glen Burnie, Md.

[73] Assignee: Westinghouse Electric Corporation, Pittsburgh, Pa.

[22] Filed: Nov. 25, 1975

[21] Appl. No.: 635,484

[52] U.S. Cl. ..... 343/766; 74/25

[51] Int. Cl.[2] ..... H01Q 3/06

[58] Field of Search ..... 343/766, 763, 757, 765, 343/762; 74/25

[56] References Cited

UNITED STATES PATENTS

| | | | |
|---|---|---|---|
| 2,556,026 | 6/1951 | Carlisle | 343/765 |
| 2,643,335 | 6/1953 | Andersen | 343/763 |

*Primary Examiner*—Eli Lieberman

*Attorney, Agent, or Firm*—D. F. Straitiff

[57] ABSTRACT

A power operated radar antenna assembly for airborne use in which an antenna carried on one end of a pair of rockable arms is balanced by a pair of motors at the opposite end of such arms; unified operation of which motors effects the rocking of the arms for elevation scanning movement of the antenna.

3 Claims, 2 Drawing Figures

POWER OPERATED ANTENNA ASSEMBLY

The invention herein described was made in the course of a contract with the U.S. Department of the Air Force F33657-75-C-0265.

BACKGROUND OF THE INVENTION

1. Field of the Invention

Airborne radar antenna assemblies.

2. Description of the Prior Art

It has been the practice in airborne radar antenna assemblies to mount the antenna on one end of a tiltable arm in a manner that results in subjection of the output of the arm-tilting drive motor means to the weight of the antenna multiplied by the length of the arm.

SUMMARY OF THE INVENTION

The present invention, in providing a power-operated airborne radar antenna assembly in which the weight of the drive motor means, being disposed oppositely to the antenna on the same rockable arm, offsets the weight of such antenna and any associated apparatus, and reduces the demand placed on operation of such drive motor means.

DESCRIPTION OF THE PREFERRED EMBODIMENT

Figure 1:
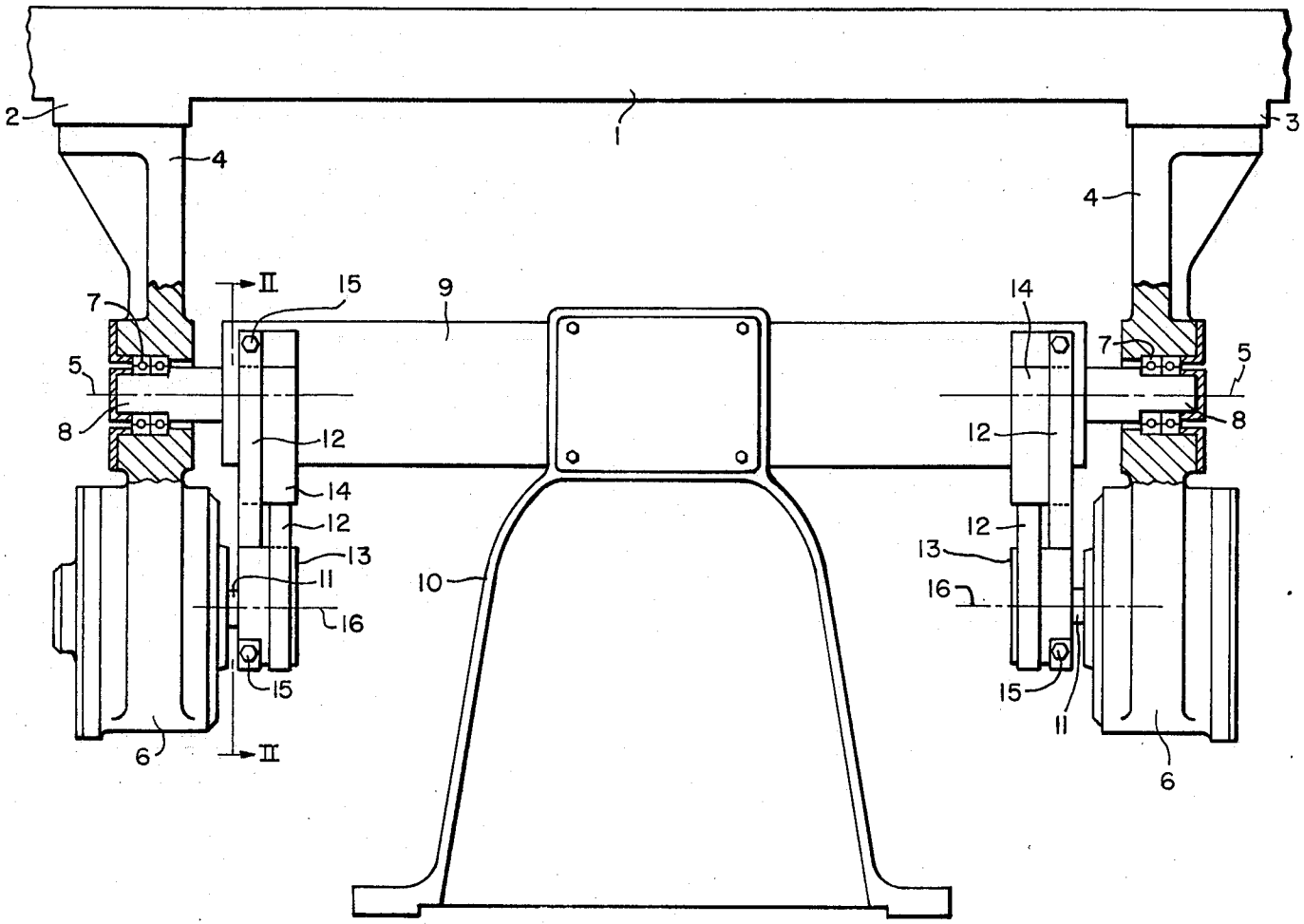
FIG. 1 is a top view, predominately in outline but partly in section, of a schematic representation of a power operated antenna assembly embodying the invention; and, FIG. 2 is a side elevation view of a belt drive portion of the assembly of the present invention.

Referring to FIG. 1, the exemplified embodiment of the invention comprises a radar antenna 1 which may be in the form of a flat plate slotted array arranged to be fed in the usual manner by suitable waveguide means (not shown). In accord with features of the present invention, the antenna 1 is mounted at a pair of horizontally spaced apart locations 2 and 3 to the forward end of a pair of arms 4 that are rockable vertically about a horizontal axis 5 to cause the antenna 1 to nod up-and-down for scanning a forward scene or observation view, and a pair of drive motors 6 for effecting the rocking of the arms 4 are mounted at a rear end of the arms 4, behind the axis 5. According to the invention, the drive motors 6 are so located relative to the axis 5 that the weight of the antenna 1 and any other affiliated equipment located fore of the axis is balanced, so that little if any load is imposed on such motors in the static state of the assembly.

To acquire such rockable affiliation with the axis 5, the arms 4 have a friction-free rotary connection via ball bearings 7 with opposite ends 8 of a rigid shaft 9 that is fixed, relative to rotary movement about the axis 5, and is adapted for mounting on the frame of the aircraft via a bracket 10.

Figure 2:
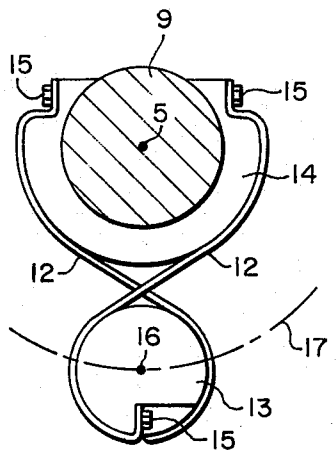
FIG. 2 being taken along the line II—II in FIG. 1.

To enable the motors 6, which as shown in the drawing are electrical and each with a rotary output shaft 11, to actuate the arms 4 for effecting their rocking movement about the axis 5, the rotary output shafts 11 of these motors are connected to the non-rotary shaft 9 through a pair of flexible metal tapes 12 and pulleys 13 and 14 affiliated with the motor shaft 11 and the non-rotary shaft 9, respectively. The tapes are wound reversely on the two pulleys and anchored at their ends thereto, as at locations 15. By turning of the pulley 13 by the shaft 11 about its axis 16—in one direction, one of the tapes 12 will be caused to roll onto the pulley 14 while the other will be caused to roll off such pulley 14, with the result that the motor housing mounted on one end of the arm 4, together with such arm end, will be caused to move orbitally about the axis 5 along the path 17 shown in FIG. 2. It will be understood that both motors 6 will operate similarly and in unison. Stop means (not shown) limits the extent of such orbital movement.

What is claimed is:

1. An antenna assembly comprising, shaft means defining a horizontal axis, arm means mounted on said shaft means for rocking movement vertically about said horizontal axis, said arm means extending fore and aft of such axis, an antenna mounted on the forward end of said arm means, motor means mounted on the rearward end of said arm means, and drive means coupling said motor means to said shaft means for effecting the aforesaid rocking movement.

2. The antenna assembly of claim 1, wherein said arm means is in form of a pair of arms spaced apart horizontally on said shaft means, and said antenna is a flat plate array radar antenna extending perpendicularly of the forward end of said arms.

3. The antenna assembly of claim 1, wherein said drive means is in the form of pulleys affiliated with said motor means and with said shaft means, respectively, and flexible tape means anchored at opposite ends to said pulleys and extending therebetween.

* * * * *